US010945508B2

(12) United States Patent
Wei

(10) Patent No.: US 10,945,508 B2
(45) Date of Patent: Mar. 16, 2021

(54) TWO-SIDE ADHERABLE HIGH-FREQUENCY INDUCTION HEATING CONTAINER SEALING MEMBER, COMPACT COSMETIC CONTAINER HAVING TAMPER FUNCTION WITH SAME APPLIED THERETO, AND FLIP CAP CONTAINER HAVING TEMPER FUNCTION WITH SAME APPLIED THERETO

(71) Applicant: SEAL AND PACK CO., LTD., Icheon-si (KR)

(72) Inventor: Se Hwang Wei, Yongin-si (KR)

( * ) Notice: Subject to any disclaimer, the term of this patent is extended or adjusted under 35 U.S.C. 154(b) by 0 days.

(21) Appl. No.: 16/483,042

(22) PCT Filed: Apr. 4, 2018

(86) PCT No.: PCT/KR2018/003980
§ 371 (c)(1),
(2) Date: Aug. 2, 2019

(87) PCT Pub. No.: WO2018/194300
PCT Pub. Date: Oct. 25, 2018

(65) Prior Publication Data

US 2020/0375339 A1 Dec. 3, 2020

(30) Foreign Application Priority Data

Apr. 17, 2017 (KR) ..... 10-2017-0049281
Apr. 17, 2017 (KR) ..... 10-2017-0049309
(Continued)

(51) Int. Cl.
*A45D 34/00* (2006.01)
*A45D 40/22* (2006.01)
(Continued)

(52) U.S. Cl.
CPC ..... *A45D 34/00* (2013.01); *A45D 40/22* (2013.01); *B65D 51/20* (2013.01);
(Continued)

(58) Field of Classification Search
CPC ..... B65D 75/5838; B65D 77/2096; B65D 77/2024; B65D 65/40; B65D 55/06; A45D 2040/0006
(Continued)

(56) References Cited

U.S. PATENT DOCUMENTS 3,317,068 A * 5/1967 Betner ..... B65D 77/208 215/233
4,533,063 A * 8/1985 Buchner ..... B65D 3/22 220/270
(Continued)

FOREIGN PATENT DOCUMENTS

JP 3935998 6/2007
JP 5115956 1/2013
(Continued)

OTHER PUBLICATIONS

English Specification of 10-1455977.
(Continued)

*Primary Examiner* — James N Smalley
(74) *Attorney, Agent, or Firm* — Antonio Ha & U.S. Patent, LLC

(57) ABSTRACT

The present disclosure relates to a two-side adherable high-frequency induction heating container sealing member, the sealing member comprising: an upper layer that comprises a first thermal-adhesion sealing layer, a first aluminum foil layer, an intermediate base layer, a synthetic resin layer having tensile strength and hardness, and a first thermal-adhesion resin layer, which are successively formed from the top to the bottom, the upper layer having a preformed
(Continued)

opening guide cut line-provided opening tab, a preformed opening guide cut strip, and a preformed thermal-adhesion sealing strip; and a lower layer that is formed beneath the upper layer and comprises a second aluminum foil layer and a second thermal-adhesion sealing layer, which are successively formed from the top to the bottom, wherein the first thermal-adhesion resin layer of the upper layer is integrated with the second aluminum foil layer of the lower layer through thermal adhesion.

20 Claims, 25 Drawing Sheets

(30) Foreign Application Priority Data

Apr. 17, 2017 (KR) ..... 10-2017-0049344
Apr. 20, 2017 (KR) ..... 10-2017-0051033
Apr. 20, 2017 (KR) ..... 10-2017-0051037
Apr. 20, 2017 (KR) ..... 10-2017-0051041

(51) Int. Cl.

| | |
|---|---|
| ***B65D 51/20*** | (2006.01) |
| ***B65D 75/58*** | (2006.01) |
| ***B65D 77/20*** | (2006.01) |
| ***A45D 40/00*** | (2006.01) |
| ***B65D 55/06*** | (2006.01) |
| ***B65D 65/40*** | (2006.01) |

(52) U.S. Cl.
CPC ..... *B65D 75/5838* (2013.01); *B65D 77/2024* (2013.01); *B65D 77/2096* (2013.01); *A45D 2034/002* (2013.01); *A45D 2040/0006* (2013.01); *B65D 55/06* (2013.01); *B65D 65/40* (2013.01)

(58) Field of Classification Search
USPC ..... 215/232; 220/359.1–359.4
See application file for complete search history.

(56) References Cited

U.S. PATENT DOCUMENTS

| | | | | |
|---|---|---|---|---|
| 4,556,152 | A * | 12/1985 | Bogren | B65D 3/268 220/270 |
| 4,616,766 | A * | 10/1986 | Miyauchi | B29C 45/14811 220/62.22 |
| 4,784,284 | A * | 11/1988 | Miyauchi | B65D 17/4012 220/270 |
| 8,740,052 | B2 * | 6/2014 | Drummond | B65D 77/2032 229/123.1 |
| 2002/0003143 | A1 * | 1/2002 | Grayer | B65D 77/2056 220/359.2 |
| 2008/0110896 | A1 * | 5/2008 | Westphal | B65D 51/20 220/359.2 |

FOREIGN PATENT DOCUMENTS

| | | |
|---|---|---|
| KR | 10-0196813 | 6/1999 |
| KR | 10-1455977 | 11/2014 |
| KR | 10-1648359 | 8/2016 |

OTHER PUBLICATIONS

English Specification of 10-1648359.
English Specification of 10-0196813.
English Specification of 5115956.
English Specification of 3935998.

* cited by examiner

[FIG. 1]
Prior Art
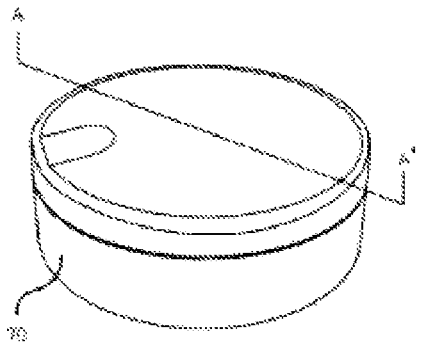
[FIG. 2]
Prior Art
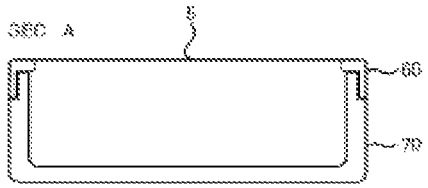
[FIG. 3]
Prior Art
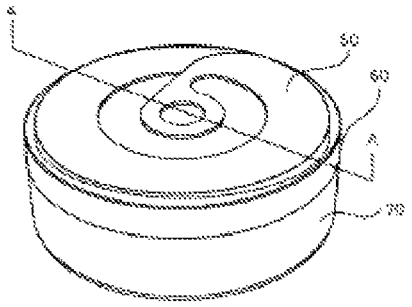

[FIG. 4]
Prior Art
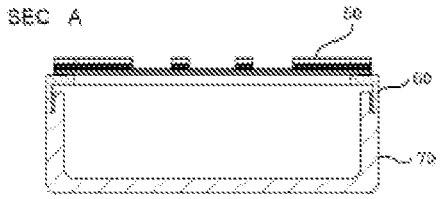

[FIG. 5]
Prior Art
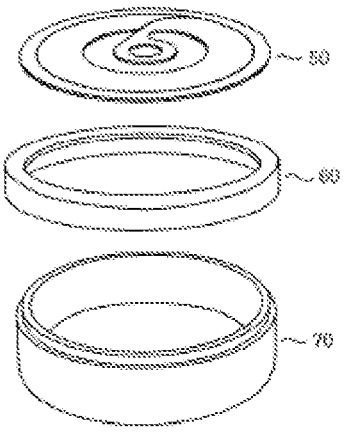
[FIG. 6]
Prior Art
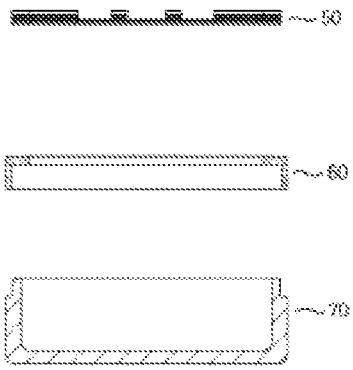

[FIG. 7]
Prior Art
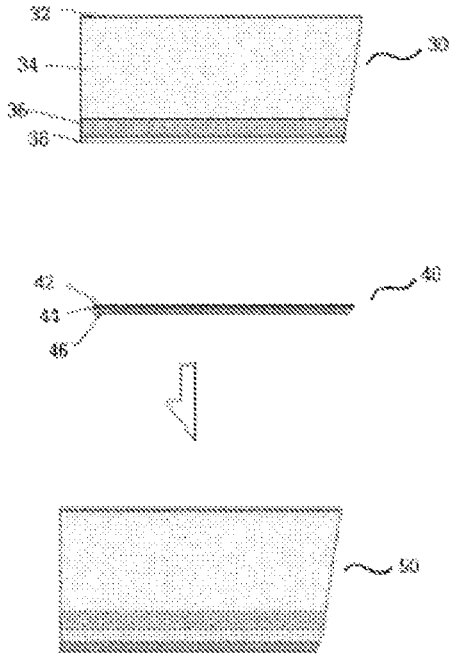
[FIG. 8]
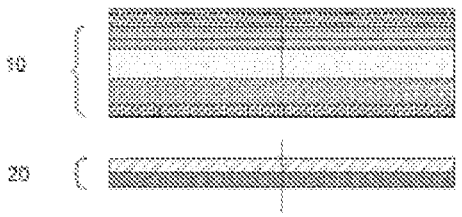

[FIG. 9]
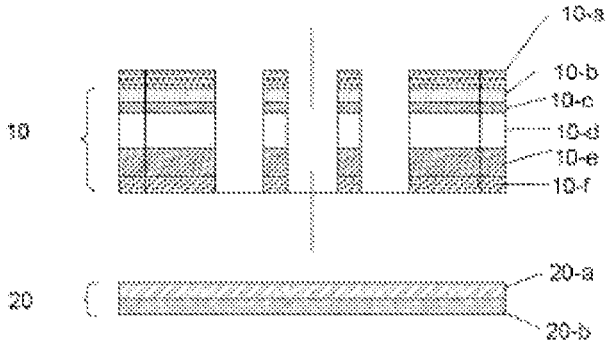

[FIG. 10]
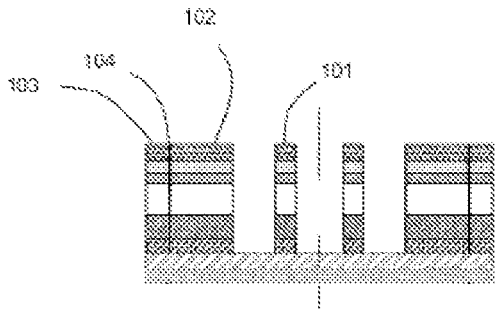
[FIG. 11]
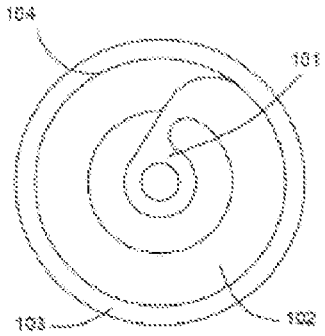

[FIG. 12]
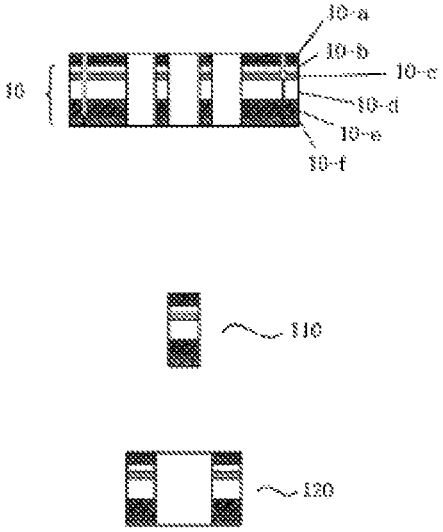

[FIG. 13]
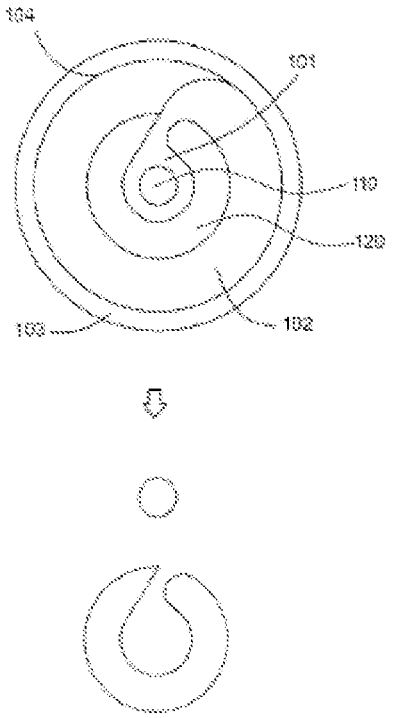
[FIG. 14]
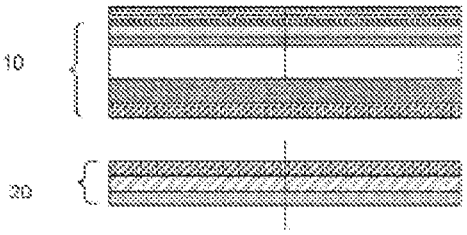

[FIG. 15]
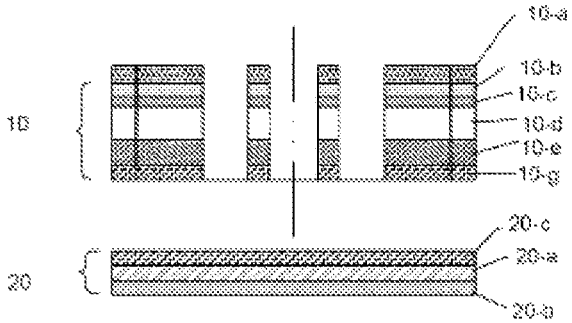

[FIG. 16]
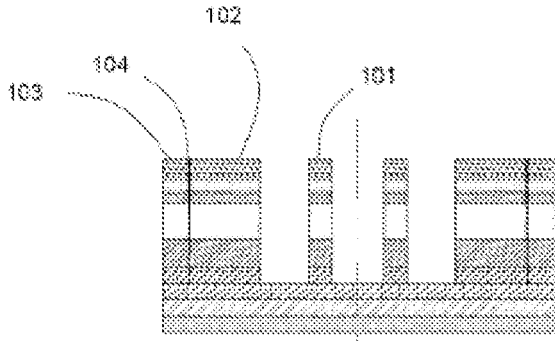

[FIG. 17]
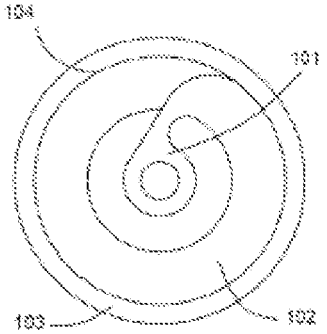
[FIG. 18]
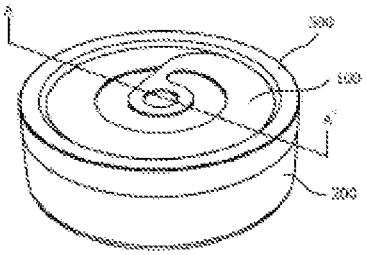
[FIG. 19]
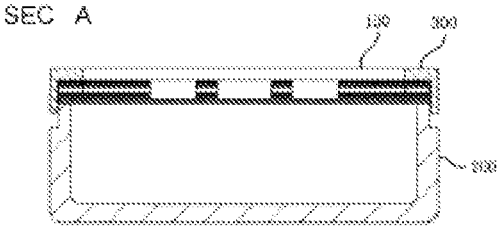

[FIG. 20]
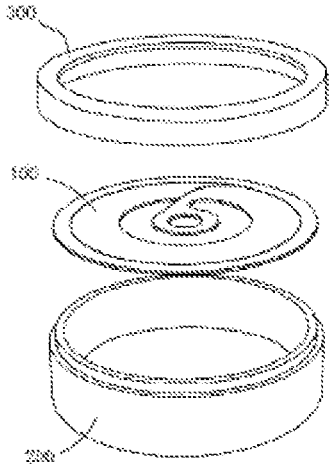
[FIG. 21]
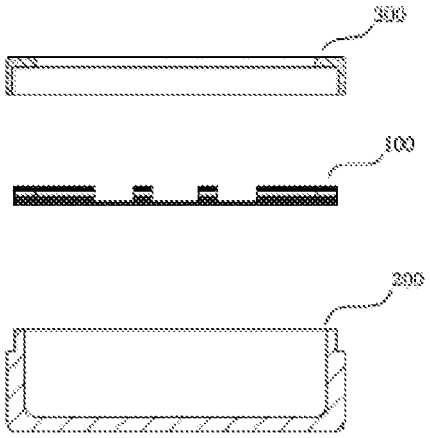

[FIG. 22]
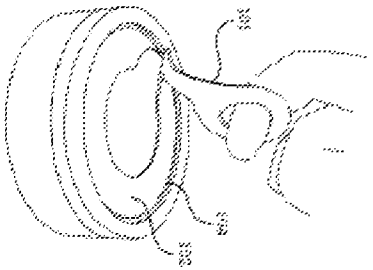

[FIG. 23]
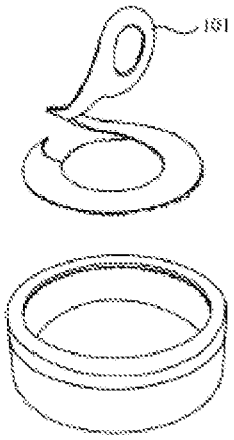
[FIG. 24]
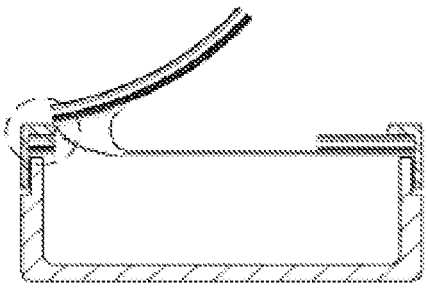
[FIG. 25]
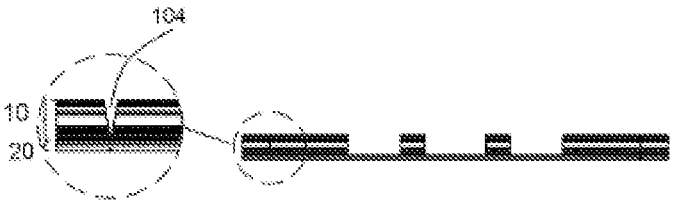

[FIG. 26]
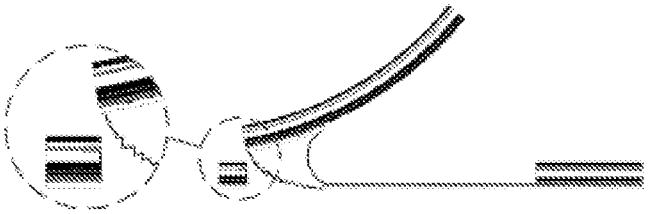
[FIG. 27]
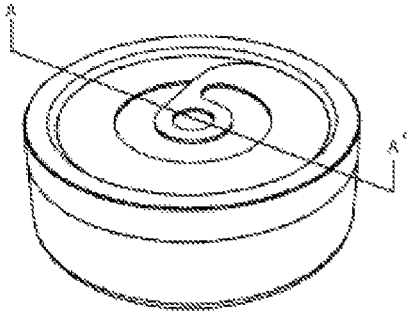
[FIG. 28]
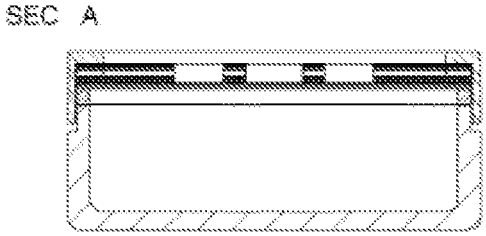

[FIG. 29]
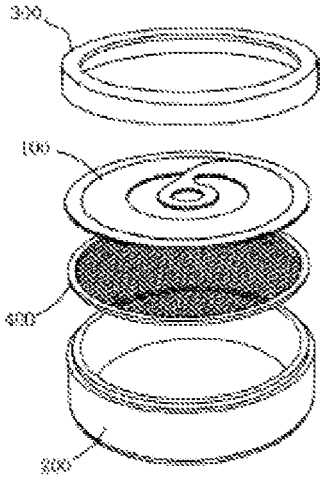

[FIG. 30]
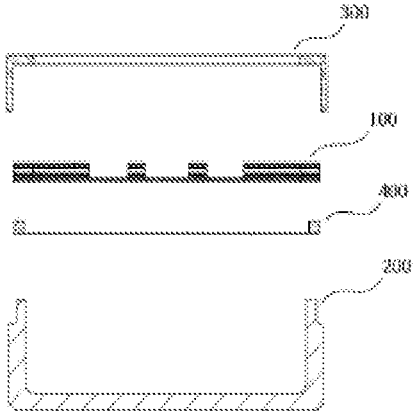
[FIG. 31]
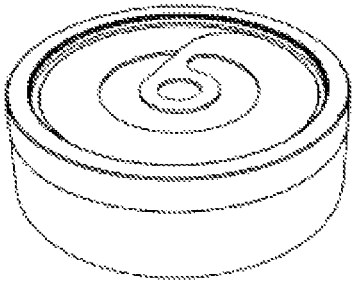
[FIG. 32]
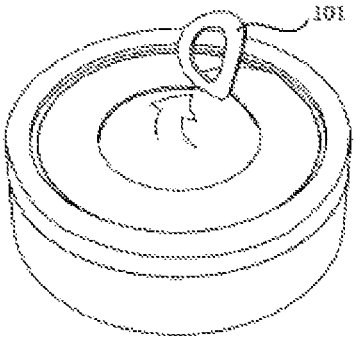

[FIG. 33]
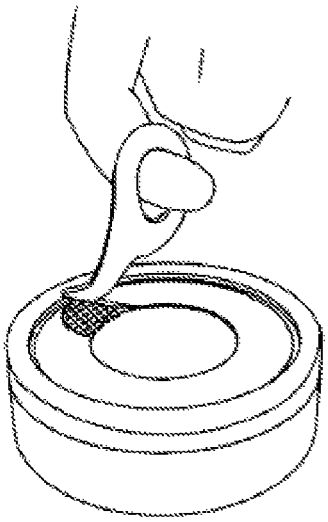
[FIG. 34]
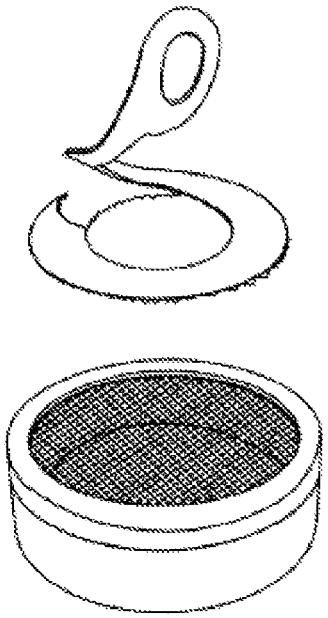

[FIG. 35]
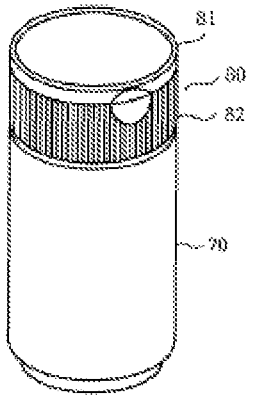
[FIG. 36]
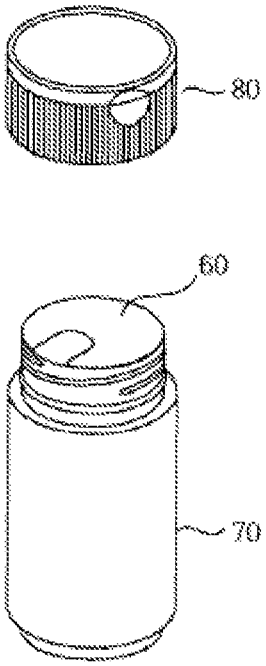

[FIG. 37]
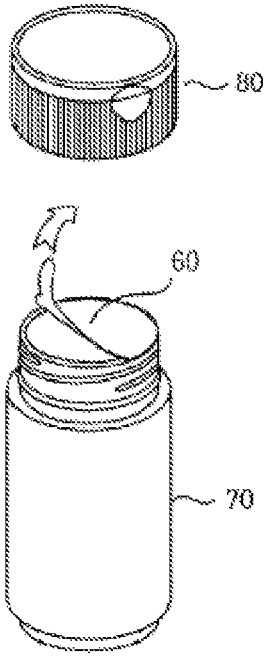
[FIG. 38]
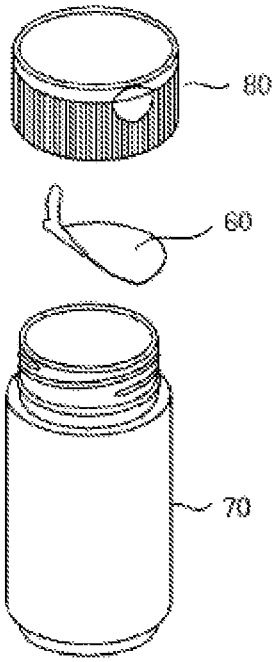

[FIG. 39]
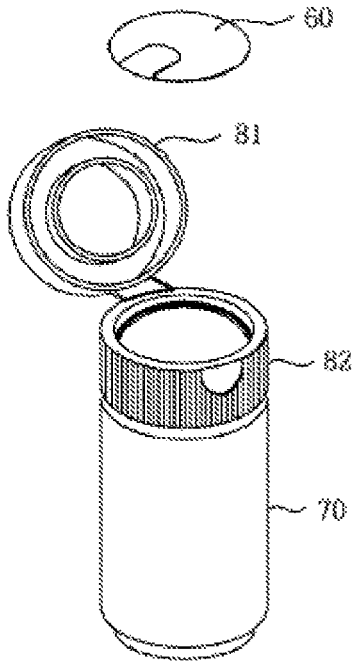
[FIG. 40]
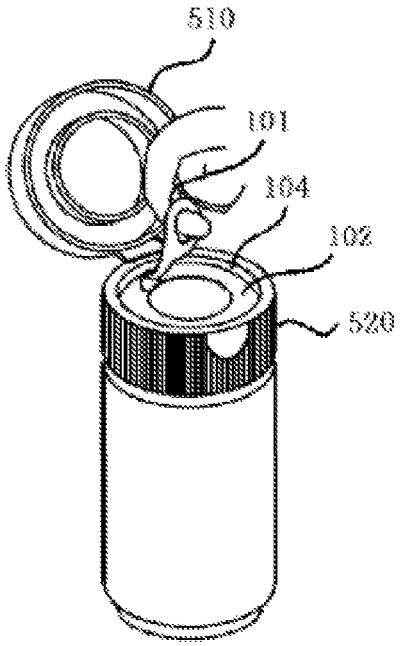

[FIG. 41]
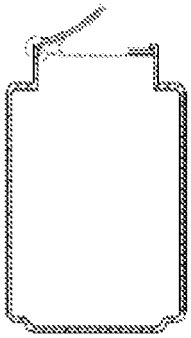
[FIG. 42]
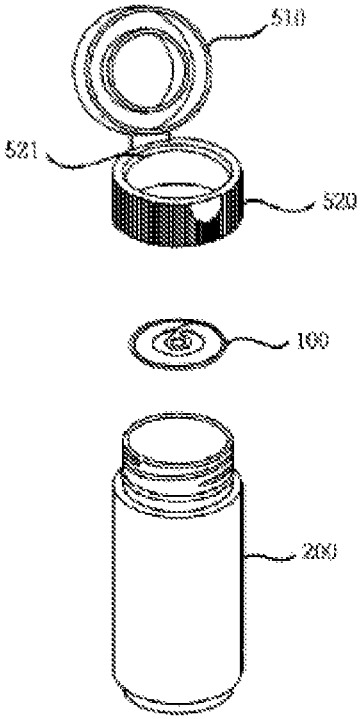

[FIG. 43]
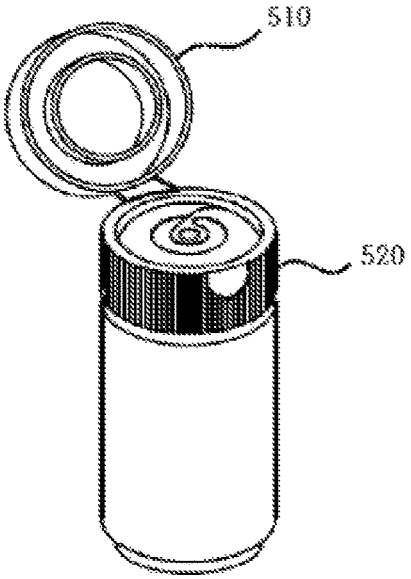
[FIG. 44]
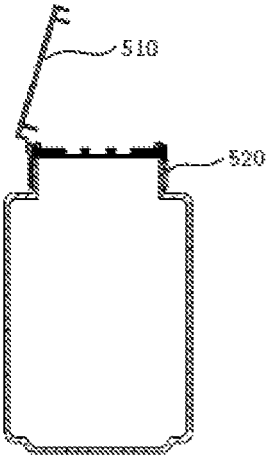

[FIG. 45]
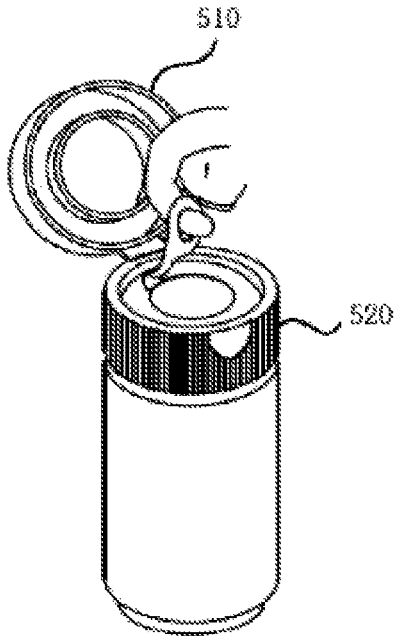
[FIG. 46]
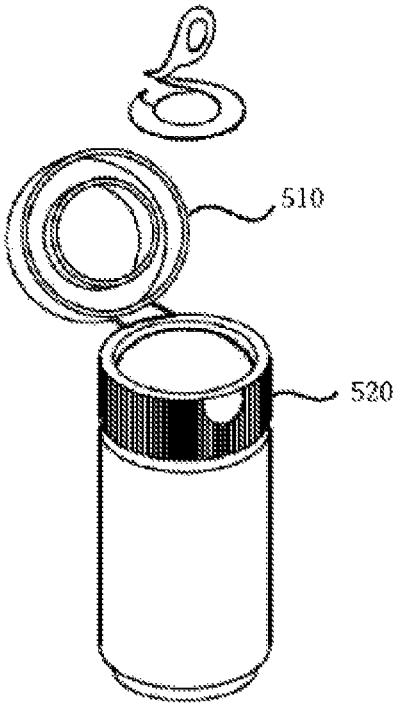

[FIG. 47]
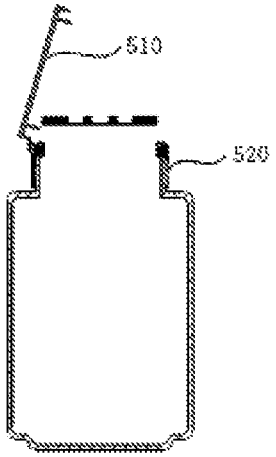

TWO-SIDE ADHERABLE HIGH-FREQUENCY INDUCTION HEATING CONTAINER SEALING MEMBER, COMPACT COSMETIC CONTAINER HAVING TAMPER FUNCTION WITH SAME APPLIED THERETO, AND FLIP CAP CONTAINER HAVING TEMPER FUNCTION WITH SAME APPLIED THERETO

TECHNICAL FIELD

The present disclosure relates to a container field having a two-side adherable high-frequency induction heating container sealing member for sealing a container having various shapes of structures at both the upper and lower surfaces, a compact cosmetic container having a tamper function using the same, and a flip-cap having a tamper function applying the two-side adherable high-frequency induction heating container sealing member.

BACKGROUND ART

A technology of sealing a container in order to protect and preserve the container contents made of a material such as general plastic, metal, or glass is widely used and in addition, a two-side adherable high-frequency induction heating container sealing member having various functions and shapes are already widely used.

As a conventional diagram, it will be described with reference to FIGS. 1 and 2 as follows.

The internal structure of the conventional compact cosmetic container has been used to heat-seal a sealant 5 made of a material such as aluminum on the upper end surface of a cover ring 60 made of a plastic material or to attach a sticker having an adhesive function in order to protect the contents and prevent leakage or evaporation, etc. of the contents in the form of a container composed of a structure having the container 70 and the cover ring 60 due to the characteristics of a product.

However, the conventional products have sealed the product by using a method for sealing the thermal container sealing member 5 made of an aluminum material on only the upper end surface of the cover ring 60 that is simply covered on a container 70, and covering the cover ring on the container by physically applying a force to a compact cosmetic container filled with the contents in an assembly-type customized method.

However, in the case of this product, there have been problems with tamper evident and heat resistance during the distribution and preservation procedure.

The conventional thermal container sealing member made of an aluminum material or the two-side adherable high-frequency induction heating container sealing member made of an adhesive sticker does not withstand a high temperature of 50 to 80° C. and is spontaneously peeled from the cover ring.

In addition, the contents have been leaked or evaporated due to the occurrence of a pin hole phenomenon, resulting in the image damage and functional problem of the product.

It will be described with reference to FIGS. 3 to 7 as follows.

Another sealing method for solving this is to apply Korean Registered Patent No. 10-1455977 developed by the present applicant to this compact cosmetic container.

As described above, it is inevitably necessary to seal the upper end surface of one accessory of the compact cosmetic container, that is, the cover ring 60 for covering the upper end of the container.

Therefore, the cover ring that has been sealed by applying the product 50 registered by the applicant is sealed but basically the cover ring is assembled while being covered on and fitted into the container.

Therefore, since pressure is simply applied to assemble due to the structure of the assembled product, the air-tightly sealing is not kept perfectly due to the insufficient application of the pressure or the dimensional tolerance of these accessories, etc.

Therefore, it is not possible to completely prevent the contents from being leaked and evaporated between the gap of the container and the cover ring.

In addition, there has been a disadvantage in that a thermal-adhesion sealing strip remains on the upper end surface of the cover ring outside after being opened, resulting in poor appearance.

The conventional container sealing member 50 is composed of an upper layer 30 and a lower layer 40, and it will be described in the order disposed from the top to the bottom of the upper layer as follows.

It will be described with reference to FIG. 7.

A Polyester film 32 having no thermal-adhesion is formed. Next, an intermediate base layer 34 is formed thereon.

Next, a Polyester film 36 is formed thereon, and then a first thermal-adhesion resin layer 38 having thermal-adhesion is formed on the lower portion for thermal-adhesion.

The upper end surface of the lower layer 40 forms a second Polypropylene film layer 42 as a second thermal-adhesion resin layer.

Next, an aluminum foil layer 44 is formed thereon, and then a thermal sealing layer 46 that can be thermally adhered is formed thereon.

Conventionally, since the two-side adherable high-frequency induction heating container sealing member 50 is not two-side adherable, the container company delivers to the cosmetic company in a state that has sealed on the upper portion of the cover ring 60.

The cosmetic company charges the contents into the container and then covers and fits the sealed cover ring on and into the container to be coupled with each other.

Therefore, a compact cosmetic container having a tamper function for perfectly sealing both the cover ring 60 and the container 70 is desperately needed.

As the conventional drawings that apply a flip-cap to the conventional container sealing member 50, FIGS. 38 to 42 and FIG. 7, which shows the conventional container sealing member 50, are used.

The internal structure of the conventional flip-cap has been used by heat-sealing the sealant 60 made of a material such as aluminum on the upper end surface of the container 70 or attaching a sticker having an adhesive function, etc. in order to protect the contents and prevent the contents from being leaked or evaporated, etc. in the form of a container composed of a structure having the container 70 and a cover 80 due to the characteristics of the product.

However, the conventional products merely seal the sealant 60 made of an aluminum material on the upper end surface of the container 70.

For use thereafter, there has been troublesome in that the consumer uses by entirely opening the flip-cap 80, removing the sealant 60, and then screw-coupling the flip-cap 80 again and opening or closing an auxiliary cap 81 of the flip-cap.

As the conventional embodiment better than the above, the product sealing the upper end surface of the container 70 by the conventional product of No. 10-1455977 (patent registered by the present applicant) can be opened by opening only the auxiliary cap of the upper portion thereof without opening the cap as in the above.

However, there has been a disadvantage in that the flip-cap and the container are integrated so as not to be separated, thereby not providing the tamper evident function to the container and the cap.

There has been a disadvantage in that this related art integrates the flip-cap and the container so as not to be separated, thereby not providing the tamper evident function to the container and the cap.

DISCLOSURE

Technical Problem

A first object is to provide a two-side adherable high-frequency induction heating container sealing member, in which the two-side adherable high-frequency induction heating container sealing member seals the upper inner circumferential surface of the cover even upwards from the two-side adherable high-frequency induction heating container sealing member and seals the inlet surface of the container downwards from the two-side adherable high-frequency induction heating container sealing member in a structure of sealing the container, thereby perfectly preventing the contents from being leaked as a result.

A second object is that the two-side adherable high-frequency induction heating container sealing member integrates and fixes the cover ring and the container so as not to be separated by sealing both the upper and lower surfaces with the two-side adherable high-frequency induction heating container sealing member interposed between the container cover and the container of a ring shape.

Therefore, the present disclosure has the object capable of providing safer and more robust product to the consumer.

A third object is to open it while an aluminum foil and a thermal-adhesion sealing layer of the lower layer are cut along the opening cut line when being opened by pulling an opening tab upwards even when being opened.

Since the opening cut line is formed on the same line as the inner circumferential line of the cover when viewing from the plane and the side surface thereof, the opened cut surface is not viewed well by the inner circumferential surface inside the cover when viewing the inlet of the container from the top thereof after being opened, thereby cleaning the opened inlet of the container.

Therefore, the present disclosure has the object that smoothes the outer surface not to harm the appearance.

A fourth object is to have the perfect tamper evident function because the two-side adherable high-frequency induction heating container sealing member weld-seals both sides between the cover ring and the container to be integrated so that the consumer can never open arbitrarily or disassemble the cover ring and the container.

An embodiment of the present disclosure has the tamper function when the two-side adherable high-frequency induction heating container sealing member is applied to the compact cosmetic container, etc.

Another embodiment of the present disclosure has the tamper function even when the two-side adherable high-frequency induction heating container sealing member is applied to a flip-cap container, etc.

Technical Solution

The present disclosure has the following configuration for achieving the objects. Formed is a two-side adherable high-frequency induction heating container sealing member including an upper layer, the upper layer forming a first thermal-adhesion sealing layer; a first aluminum foil layer; an intermediate base layer; a synthetic resin layer having tensile strength and hardness; and a first thermal-adhesion resin layer from the top to the bottom successively; and the upper layer having a preformed opening guide cut line-provided opening tab; a preformed opening guide cut strip, and a preformed thermal-adhesion sealing strip; and a lower layer, the lower layer forming a second aluminum foil layer; and a second thermal-adhesion sealing layer from the top to the bottom successively, the first thermal-adhesion resin layer on the upper layer and the second aluminum foil layer on the lower layer are integrated by the thermal adhesion.

Herein, as another method, a second thermal-adhesion resin layer is further formed on the upper portion of the second aluminum foil layer.

Herein, the first thermal-adhesion resin layer formed on the lower end portion of the upper layer is made of Polymer made of Copolymer of Ethylene Vinyl Acetate or Ethylene Acrylic Acid having the strong thermal-adhesion against metal so as to have the thermal adhesion with the aluminum foil layer formed on the lower layer.

Herein, it is preferable that the first thermal-adhesion resin layer forms a layer by coating by using an extrusion device or laminating a film for the coupling with the Polyester layer.

Herein, it is preferable that the first thermal-adhesion resin layer is formed by coating a hot-melt adhesive agent made of the main material of Nylon, Ethylene Vinyl Acetate, Polyester, etc. or laminating a film, etc.

Herein, the synthetic resin layer is formed of a film made of Polyester, Polypropylene or Polycarbonate bi-axially stretched to be selected as one having strong hardness and tensile force. Particularly, the Polyester film is excellent in terms of cost and performance.

Herein, the second thermal-adhesion resin layer is laminated on the upper portion of the second aluminum foil layer so that the upper layer and the lower layer are integrated by applying heat and pressure thereto, and the first thermal-adhesion resin layer and the second thermal-adhesion resin layer are made of Heat Seal Polymer of the same material made of Polyethylene, Polypropylene, or Ethylene Vinyl Acetate to form so that the second aluminum foil layer is not directly exposed to the air, thereby preventing oxidation and having high heat resistance.

Herein, it is preferable that the first thermal-adhesion sealing layer and the second thermal-adhesion sealing layer are made of thermoplastic adhesion resin of the same material as those of the cover and the container attached by applying the two-side adherable high-frequency induction heating container sealing member.

Herein, it is preferable that the material of the thermoplastic adhesion resin is made of Polyethylene, Polypropylene, Polyethylene Terephthalate, and Ethylene Vinyl Acetate, etc.

Herein, it is preferable that the second thermal-adhesion sealing layer is made of Ionomer or Ethylene Acrylic Acid when the material of the container is a glass or metal material.

Of course, it is preferable that the first thermal-adhesion sealing layer is also made of Ionomer or Ethylene Acrylic Acid equally when the material of the cover ring is a glass or metal material.

Herein, it is preferable that the first aluminum foil layer and the second aluminum foil layer are formed in a thickness of 0.009 to 0.1 mm.

Herein, it is preferable that a print film layer for printing a design and a trademark or a business name for promoting a product is further formed between the first thermal-adhesion sealing layer and the first aluminum foil layer.

Herein, the print film layer is formed in a thickness of 0.008 to 0.03 mm. Herein, it is preferable that the material of the print film layer is made of a Polyester film or a Polypropylene film.

The thickness of the aluminum foil layer or the print film layer is digitized considering function and economical efficiency, and it is preferable to be used within a range of the appropriate thickness according to the type or application, etc. of the contents of the product.

In applying the two-side adherable high-frequency induction heating container sealing member to the upper portion of the container, As having the tamper function applying the two-side adherable high-frequency induction heating container sealing member formed so that the two-side adherable high-frequency induction heating container sealing member is formed between the container and the cover to be integrally sealed when passing through an induction heating device, the flip-cap of goods such as the compact cosmetic container, pharmaceuticals or foods is applied to the container.

Preferably, the opening guide cut line is formed to coincide with the inner circumferential surface of the cover or at the outside of the inner circumferential surface of the cover so that the cut surface of the two-side adherable high-frequency induction heating container sealing member is not viewed well when viewing the cover and the inlet of the container from the top in a state where the two-side adherable high-frequency induction heating container sealing member has been opened.

Advantageous Effects

As a first effect, it is possible for the two-side adherable high-frequency induction heating container sealing member of the present disclosure to seal the upper inner circumferential surface of the cover even upwards from the two-side adherable high-frequency induction heating container sealing member and to seal the inlet surface of the container downwards from the two-side adherable high-frequency induction heating container sealing member, thereby perfectly preventing the contents from being leaked as a result.

As a second effect, it is possible for the two-side adherable high-frequency induction heating container sealing member to seal both the upper and lower surfaces with the two-side adherable high-frequency induction heating container sealing member interposed between the container cover and the container of the ring shape, thereby integrating and fixing the cover ring and the container so as not to be separated.

As a third effect, it is possible to be opened while the aluminum foil and the thermal-adhesion sealing layer of the lower layer are cut along the opening cut line when being opened by pulling the opening tab upwards even when being opened.

The opening cut line is formed on the same line as the inner circumferential line of the cover when viewing from the plane and the side surface thereof when being opened, the opened cut surface is not viewed well by the inner circumferential surface inside the cover when viewing the inlet of the container from the top after being opened, thereby cleaning the opened inlet of the container.

Therefore, it is possible to smooth the outer surface, thereby not harming the appearance.

As a fourth effect, it is possible for the two-side adherable high-frequency induction heating container sealing member to weld-seal both sides between the cover ring and the container to be integrated so that the consumer can never open arbitrarily or disassemble the cover ring and the container, thereby having the perfect tamper evident effect.

DESCRIPTION OF DRAWINGS

FIG. 1 is a diagram showing that a conventional sealing member has been applied between a cover and a container.

FIG. 2 is a cross-sectional diagram of the line A-A' of FIG. 1.

FIG. 3 is a diagram showing that another conventional sealing member (sealing member invented and registered by the applicant) has been applied between the cover and the container.

FIG. 4 is a cross-sectional diagram of the line A-A' of FIG. 3.

FIG. 5 is an exploded diagram of FIG. 3.

FIG. 6 is a cross-sectional diagram for each part of FIG. 5.

FIG. 7 is a diagram relating to a conventional method for manufacturing a two-side adherable high-frequency induction heating container sealing member 50 of FIG. 5.

FIG. 8 is a diagram showing a first embodiment of a method for manufacturing an upper layer and a lower layer as a diagram relating to a method for manufacturing the product of the present disclosure.

FIG. 9 is a diagram showing a method for manufacturing the upper layer of a two-side adherable high-frequency induction heating container sealing member that performs an operation of punching and cutting an opening tab, an opening guide cut strip, a thermal-adhesion sealing strip, and an opening guide cut line on the upper layer.

FIG. 10 is a cross-sectional diagram showing that the upper layer and the lower layer of FIG. 9 have been attached.

FIG. 11 is a diagram showing the two-side adherable high-frequency induction heating container sealing member of the present disclosure.

FIG. 12 is a cross-sectional diagram for explaining a method for punching and cutting the upper layer of FIG. 11.

FIG. 13 is a plane diagram for explaining the method for punching and cutting the upper layer in FIG. 11.

FIG. 14 is a diagram showing a second embodiment of the method for manufacturing the upper layer and the lower layer as a diagram relating to the method for manufacturing the product of the present disclosure.

FIG. 15 is a diagram showing that a second thermal-adhesion resin layer is formed on the upper portion of the lower layer of FIG. 9.

FIG. 16 is a cross-sectional diagram showing that the upper layer and the lower layer of FIG. 15 have been attached.

FIG. 17 is a diagram showing the two-side adherable high-frequency induction heating container sealing member of the present disclosure.

FIG. 18 is a diagram showing that the two-side adherable high-frequency induction heating container sealing member of the present disclosure has been applied between the cover and the container such as a ring as a diagram for explaining an Application embodiment 1 applying the present disclosure.

FIG. 19 is a cross-sectional diagram of the line A-A' of FIG. 18.

FIG. 20 is an exploded diagram of FIG. 18.

FIG. 21 is a cross-sectional diagram for each part of FIG. 20.

FIG. 22 is a diagram showing a state where the two-side adherable high-frequency induction heating container sealing member starts to be torn from a compact cosmetic container applying the product of the present disclosure.

FIG. 23 is a diagram showing a state where the two-side adherable high-frequency induction heating container sealing member is torn from the container.

FIG. 24 is a cross-sectional diagram of FIG. 22.

FIG. 25 is an enlarged diagram of the cross-sectional diagram of the two-side adherable high-frequency induction heating container sealing member applied to FIG. 22.

FIG. 26 is a cross-sectional diagram showing that tearing proceeds by further advancing the state of FIG. 24.

FIG. 27 is a diagram for explaining an Application embodiment 2 applying the present disclosure, and is a diagram showing that a mesh fixing ring including a mesh is formed between the cover ring and the container to apply the two-side adherable high-frequency induction heating container sealing member between the mesh fixing ring including the mesh and the cover ring.

FIG. 28 is a cross-sectional diagram of the line A-A' of FIG. 27.

FIG. 29 is an exploded diagram of FIG. 27.

FIG. 30 is a cross-sectional diagram for each part of FIG. 29.

FIG. 31 corresponds to FIG. 27, and is a diagram showing the container to which the two-side adherable high-frequency induction heating container sealing member has been applied.

FIG. 32 is a diagram of a first stage of tearing the two-side adherable high-frequency induction heating container sealing member FIG. 31 from the container.

FIG. 33 is a diagram showing a second stage of advancing a state of further tearing in the first stage of tearing the two-side adherable high-frequency induction heating container sealing member of FIG. 32 from the container.

FIG. 34 is a diagram showing a state where the two-side adherable high-frequency induction heating container sealing member has been torn from the container.

FIG. 35 is a diagram showing that the conventional sealing member has been applied between the flip-cap and the container.

FIG. 36 is a diagram showing that the flip-cap is opened in order to tear the sealing member in FIG. 35.

FIG. 37 is a diagram showing that the sealing member of FIG. 36 starts to be torn.

FIG. 38 is a diagram showing that the sealing member has been removed from the container.

FIG. 39 is a diagram showing that the contents are used by screw-coupling the flip-cap and then opening an auxiliary cap.

FIG. 40 is a diagram showing a state where the two-side adherable high-frequency induction heating container sealing member starts to be torn from the flip-cap container applied to the present product and is a diagram showing an Application embodiment 3.

FIG. 41 is a cross-sectional diagram of FIG. 40.

FIG. 42 is an exploded diagram of FIG. 40.

FIG. 43 is a diagram showing a state where the auxiliary cap of the flip-cap has been opened after applying the two-side adherable high-frequency induction heating container sealing member to the flip-cap.

FIG. 44 is a cross-sectional diagram of FIG. 43.

FIG. 45 is a diagram showing a first stage of tearing the two-side adherable high-frequency induction heating container sealing member from the container.

FIG. 46 is a diagram showing a state where the two-side adherable high-frequency induction heating container sealing member has been torn from the container.

FIG. 47 is a cross-sectional diagram of FIG. 46.

BEST MODE

As the best mode for embodying the present disclosure, FIGS. 18 to 26 relates to an Application embodiment 1 that has applied the above-described two-side adherable high-frequency induction heating container sealing member to a container.

FIG. 18 is a diagram for explaining an Application embodiment 1 applying the two-side adherable high-frequency induction heating container sealing member of the present disclosure to the container and is a diagram showing that a two-side adherable high-frequency induction heating container sealing member 100 of the present disclosure has been applied between a cover ring 300 and a container 200.

Formed is a compact cosmetic container applying the two-side adherable high-frequency induction heating container sealing member 100 formed so that the two-side adherable high-frequency induction heating container sealing member 100 of the present disclosure is formed between the container 200 and the cover ring 300 to be integrally sealed when passing through an induction heating device, in the compact cosmetic container composed of the container 200; and the cover ring 300 on the upper portion of the container 200.

Shown is a state where the inlet surface of the container 200 and the lower inner surface of the cover ring 300 have been sealed on both side surfaces of the uppermost surface and the lowermost surface of the two-side adherable high-frequency induction heating container sealing member 100 of the present disclosure.

The present disclosure provides a function for protecting the consumer by a role such as tamper evident.

Since the product of the present disclosure seals the container, it can be recognized when someone releases the sealing, thereby confirming whether the product is defective.

FIG. 19 is a cross-sectional diagram of the line A-A' of FIG. 18.

It can be seen that the two-side adherable high-frequency induction heating container sealing member 100 of the present disclosure is disposed between the container 200 and the cover ring 300.

FIG. 20 is an exploded diagram of FIG. 18.

FIG. 20 is a diagram showing a structure disposed from the bottom to the top, and is composed of the container 200, the two-side adherable high-frequency induction heating container sealing member 100 of the present disclosure, and the cover ring 300.

FIG. 21 is a cross-sectional diagram for each part of FIG. 20.

FIG. 22 is a diagram showing a state where the two-side adherable high-frequency induction heating container sealing member starts to be torn from the compact cosmetic container applying the product of the present disclosure.

FIG. 22 is a diagram showing that an opening tab 101 and an opening guide cut strip 102, which are the central inner surface, starts to be separated together with a second aluminum foil layer adhered to the lower portion thereof along an opening guide cut line 104 of the two-side adherable high-frequency induction heating container sealing member that is present on the same positional line as the inner circumferential surface on the lower portion of the cover ring 300, when the opening tab 101 on the upper central portion of the two-side adherable high-frequency induction heating container sealing member 100 is pulled upwards.

FIG. 23 is a diagram showing a state where the opening tab has been further separated together with the second aluminum foil layer in FIG. 22 to be detached from the container.

FIG. 24 is a cross-sectional diagram of FIG. 22.

FIG. 25 is an enlarged diagram of the cross-sectional diagram in which the opening guide cut line 104 has been formed on the two-side adherable high-frequency induction heating container sealing member applied to FIG. 22.

FIG. 25 is a diagram showing that the two-side adherable high-frequency induction heating container sealing member that is the product of the present disclosure, has been applied to seal the cover ring 300 and the container 200, and shows a state where a first thermal-adhesion sealing layer 10-*a*, which is the uppermost surface of the upper layer of the two-side adherable high-frequency induction heating container sealing member, is thermally adhered to the upper inner circumferential surface of the cover ring to be sealed and a second thermal-adhesion sealing layer 20-*b*, which is the lowermost surface of the lower layer that is the opposite surface thereto, is thermally adhered to the inlet surface of the container 200 to be sealed.

FIG. 23 is a diagram showing a state where the two-side adherable high-frequency induction heating container sealing member has been torn from the container.

As shown in FIGS. 24 to 26, the opening guide cut line 104 is formed to coincide with the inner circumferential surface of the cover ring 300 or at the outside of the inner circumferential surface of the cover ring 300 to form so that the cut surface of the two-side adherable high-frequency induction heating container sealing member is not viewed well when viewing the cover ring and the inlet of the container from the top in a state where the two-side adherable high-frequency induction heating container sealing member has been opened, and is formed so that the opened boundary surface portion is not viewed well from the outside when the two-side adherable high-frequency induction heating container sealing member 100 has been detached from the container, such that the appearance is neatly seen even after the container has been opened.

The present disclosure will be described in detail with reference to the drawings below.

First Embodiment

FIGS. 8 to 13 are diagrams relating to a first embodiment that manufactures the two-side adherable high-frequency induction heating container sealing member.

FIGS. 8 and 9 are diagrams relating to a method for manufacturing the product of the present disclosure, and are diagrams showing a method for manufacturing a two-side adherable high-frequency induction heating container sealing member for coupling the upper layer and the lower layer.

The fact that the two-side adherable high-frequency induction heating container sealing member 100 of the present disclosure is largely divided into an upper layer 10 and a lower layer 20 when each layer is viewed in cross section and the upper layer 10 has each layer formed from the upper surface to the lower surface again will be described for each layer.

The first thermal-adhesion sealing layer 10-*a* is formed. It couples the upper inner circumferential surface of the cover ring 300.

The first thermal-adhesion sealing layer 10-*a* is a layer for sealing the upper inner circumferential surface of the cover ring 300 for covering the inner container and the cover ring 300 should be made of a thermoplastic material in order to seal the cover ring 300, and in addition, the first thermal-adhesion sealing layer 10-*a* should be also made of a thermoplastic material of the same material. In addition, the first thermal-adhesion sealing layer 10-*a* is preferably Polypropylene or polyethylene.

The first thermal-adhesion sealing layer 10-*a* couples to the upper inner circumferential surface of the cover ring 300.

Herein, a print film layer for printing a design and a trademark or a business name for promoting the product can be further formed between the first thermal-adhesion sealing layer 10-*a* and a first aluminum foil layer 10-*c*.

The print film layer 10-*b* is a layer that can be selected according to the presence or absence of print.

The print film layer 10-*b* can also be placed for printing and the print layer can be omitted if printing is not required. Hereinafter, the print film layer will be described. It is preferable that the print film layer is formed to have a thickness of 0.008 to 0.03 mm. It is preferable that the material of the print film layer is made of a Polyester film or a Polypropylene film.

Since the manufacturing order of forming the above-described layer can also be changed according to the circumstance of the manufacturing procedure in first laminating any one among various multi-layer films, the fixed order is not determined but generally in the case of the rollable soft packaging product, the print process is first performed and then the laminating process is performed.

Therefore, the product first prints the print film layer (a Polyester film, or a Polypropylene film) and then performs the laminating process with another layer.

Then, in the case of the product not requiring the print, the print film layer is omitted and the upper layer is formed. Then, the lower surface of the first thermal-adhesion sealing layer 10-*a* or the upper surface of the first aluminum foil layer 10-*c* can also be directly printed to form the upper layer having the print on the upper portion without the print film layer.

However, the reason why a separate print film layer is required is because it is universally convenient to print on a thin Polyester or Polypropylene film layer and the direct print on the first thermal-adhesion sealing layer 10-*a* or the first aluminum foil layer 10-*c* is picky and difficult due to the stretch problem of fabric, such that it is preferable to use a separate print film.

As the next layer, the first aluminum foil layer 10-*c* is formed thereon.

The first aluminum foil layer 10-*c* is a layer for generating heat by high-frequency induction heating, and has a function that the thus generated heat melts the first thermal-adhesion sealing layer 10-*a* of the uppermost portion thereof by heat transfer to be thermally adhered to the upper inner circumferential surface of the cover ring.

Since the heat inductively heated by the second aluminum foil layer formed on the lower layer is not transferred well due to an intermediate base layer 10-*d* described below upwards, it is necessary to form the first aluminum foil layer 10-*c* on the upper portion of the intermediate base layer.

The reason why the first aluminum foil layer 10-*c* is required is because if the second aluminum foil layer 20-*a* is formed only on the lower layer as in a configuration of the conventional sealing member, the heat inductively heated in the second aluminum foil layer 20-*a* is transferred well downwards because the second thermal-adhesion sealing layer 20-*b* has been directly laminated but since the heat is blocked upwards by the Polyester film layer 10-*e* and the intermediate base layer 10-*d* formed in a relatively thick layer not to heat the first thermal-adhesion sealing layer 10-*a* and not to be thermally adhered to the upper inner circumferential surface of the cover ring 300 on the upper portion thereof, the first aluminum foil layer 10-*c* is inevitably needed in order to heat the first thermal-adhesion sealing layer 10-*a*.

Hereinafter, the intermediate base layer 10-*d* is formed on the lower portion thereof.

The intermediate base layer 10-*d* is a layer formed of a film or a sheet formed by foaming a material such as polyethylene, Polypropylene, or ethylene vinyl acetate and the film or the sheet has the elasticity due to the characteristics of the foamed material, such that when the cover ring 300 is covered on the container 200 and pressure is applied thereto, the two-side adherable high-frequency induction heating container sealing member has a function of improving the close-contact performance, and the intermediate base layer having appropriate and various thicknesses of 0.1 to 2 mm is formed to hold the opening tab 101 strongly even while feeling a comfortable grip sensitivity when the opening tab 101 of the upper layer thereof is held with the finger. Next, a synthetic resin layer having high tensile strength and hardness is formed thereon.

It is preferable that the synthetic resin layer is formed of a Polyester layer 10-*e*. The synthetic resin layer serves so that the foil layer is neatly torn in hardness. The synthetic resin layer is formed of a Polypropylene or Polycarbonate film in addition to a Polyester film bi-axially stretched to be selected as one having the strong hardness and tensile force.

As in FIGS. 24 and 26, a force is also applied upwards to the opening guide cut strip 102 connected thereto while the opening tab 101 is lifted upwards and the opening guide cut strip 102 is crossed with and separated from a thermal-adhesion sealing strip 103 thermally adhered and fixed to the inlet of the container 200, and the Polyester film and the Polypropylene film or Polycarbonate film serves as a scissor when the opening guide cut strip 102 and the thermal-adhesion sealing strip 103 are crossed with and separated from each other due to the thus crossed physical force and the high hardness owned by the Polyester film and the Polypropylene film or Polycarbonate film bi-axially stretched and used as the synthetic resin layer, and serves to open while the second aluminum foil layer 20-*a* and the second thermal-adhesion sealing layer 20-*b* thermally adhered to the lower portion thereof is subject to shear failure.

The Polyester film layer 10-*e* plays a very important role functionally and the Polyester film layer has a relatively thick thickness of 0.05 to 0.2 mm, and the upper layer 10 including the opening tab 101 and the opening guide cut strip 102 including this layer has the strong tensile strength.

Next, a first thermal-adhesion resin layer 10-*f* is successively laminated to be integrated. As a result, the upper layer is completed.

The first thermal-adhesion resin layer 10-*f*, which is the lower surface of the upper layer, is manufactured by using the following material or method.

The first thermal-adhesion resin layer 10-*f* is made of Polymer made of Copolymer of Ethylene Vinyl Acetate or Ethylene Acrylic Acid that is well thermally adhered to the second aluminum foil layer 20-*a*, which is the upper portion of the lower layer 20.

The first thermal-adhesion resin layer 10-*f* forms a layer by coating by using an extrusion device or laminating a film.

In addition, when the first thermal-adhesion resin layer is formed by using a hot melt adhesive agent, a hot melt adhesive agent made of a raw material such as Nylon, Ethylene Vinyl Acetate, or Polyester is directly coated on the lower surface of the Polyester film layer so that this layer is thermally adhered to the second aluminum foil layer 20-*a* of the lower layer.

The first thermal-adhesion resin layer 10-*f* having the function of allowing the upper layer 10 and the lower layer 20 of the two-side adherable high-frequency induction heating container sealing member to be integrated by applying heat and pressure by using the first thermal-adhesion resin layer 10-*f* is adhered to the lower surface of the Polyester layer of the upper layer and is formed to be strongly adhered with the aluminum foil layer on the lower portion thereof at a force of 2 kgf/15 mm or more (2 kgf/15 mm is generally an unit of the force indicating adhesion strength and peel strength, etc., and indicates the magnitude of a force of 2 kg when the sample having 15 mm in width of the film is separated from each other by holding it, respectively, when two layers are adhered to each other and it is tested whether the adhered film has been kept adhered by a force of any degree, for example).

The first thermal-adhesion resin layer 10-*f* is made of Polymer made of Copolymer of Ethylene Vinyl Acetate or Ethylene Acrylic Acid that is well thermally adhered to a metal layer such as the aluminum as described above so as to have a strong thermal-adhesion force at a force of 2 kgf/15 mm or more.

The upper layer 10 thus integrated has preformed the opening tab 101, the opening guide cut strip 102, the thermal-adhesion sealing strip 103, and the opening guide cut line 104 by cutting and press operations, etc.

Since the upper layer 10 formed of a sheet or a film formed in the form of the thus completed multi-layer film forms the opening tab 101 and the opening guide cut strip 102, etc. by cutting and press operations and the unnecessary scrap is removed, a structure of the opening tab 101, the opening guide cut strip 102, and the thermal-adhesion sealing strip 103 is the same as a single-layer structure of the upper layer described above.

Next, the lower layer will be described.

Shown is that the lower layer 20 of the two-side adherable high-frequency induction heating container sealing member 100 is a layer of sealing the inlet of the actual container and is composed of the second aluminum foil layer 20-*a* and the second thermal-adhesion sealing layer 20-*b*, and the second aluminum foil layer 20-*a*, which is the upper end surface of the lower layer 20, is strongly thermally adhered with the first thermal-adhesion resin layer 10-*f*, which is the lower end surface of the upper layer 10, to form the entire container sealing member 100 of the present disclosure.

The second aluminum foil layer 20-*a* is a layer for high-frequency induction heating and melts the second thermal-adhesion sealing layer 20-*b*, which is the lowermost portion of the lower layer, downwards by the heat thus generated by the induction heating to be thermally adhered with the container, and on the other hand, is a layer of sealing the container substantially together with the second thermal-adhesion sealing layer and blocks moisture or oxygen, etc. from the outside due to the characteristics of the metal material from being transmitted, thereby preventing the contents from being changed and also preventing the contents of the container from being leaked or evaporated. Then, the second aluminum foil layer is subject to shear failure together with the second thermal-adhesion sealing layer of the lower layer thereof when being opened to serve as the seal to be opened.

The second thermal-adhesion sealing layer 20-*b* on the lower portion thereof is a layer that is disposed on the lower layer, that is, the lowermost portion of the two-side adherable high-frequency induction heating container sealing member so that the two-side adherable high-frequency induction heating container sealing member is thermally adhered with the container 200 or the mesh fixing ring 400 including a mesh, etc. and is made of the same material as that of the container 200 or the mesh fixing ring including the mesh so as to be strongly weld-sealed. The material of the lower layer is made of Heat Seal Polymer such as Polyethylene, Polypropylene, amorphous Polyester, or Ethylene Vinyl Acetate, etc. having the same thermal adhesion according to the material of the container 200.

The second thermal-adhesion sealing layer 20-*b* is a layer that is disposed on the lower layer 20, that is, the lowermost portion of the sealant so that the sealant is thermally adhered with the container 200 and is made of the same material as that of the container 200 so as to be strongly weld-sealed. The material of the lower layer is made of Heat Seal Polymer of one or more ones selected from Polyethylene, Polypropylene, amorphous Polyester, or Ethylene Vinyl Acetate, etc. having the same thermal adhesion according to the material of the container 200.

FIG. 9 is a diagram showing a method for manufacturing the upper layer 10 of the two-side adherable high-frequency induction heating container sealing member 100 by punching and cutting the opening tab 101, the opening guide cut strip 102, the thermal-adhesion sealing strip 103, and the opening guide cut line 104 on the upper layer by a press operation.

FIG. 10 is a cross-sectional diagram showing that the upper layer and the lower layer of FIG. 9 have been attached.

FIG. 11 is a diagram showing the two-side adherable high-frequency induction heating container sealing member of the present disclosure.

FIG. 11 is a diagram showing that the opening tab 101, the opening guide cut strip 102, the thermal-adhesion sealing strip 103, and the opening guide cut line 104 are formed on the upper layer.

FIGS. 12 and 13 relate to a cross-sectional diagram and a plane diagram for explaining through an operation of punching and cutting the upper layer of FIG. 11 by a press operation.

After forming the film and the sheet of the upper layer 10, in order to form the opening tab 101, the opening guide cut strip 102, the thermal-adhesion sealing strip 103, and the opening guide cut line 104, as in FIG. 13, the upper layer is completed by removing a circular shape 110 by the punching operation so as to place the finger, also removing a ring shape 120 by the punching operation, and also performing a complete cutting operation for the opening guide cut line 140.

The operation can be performed simultaneously or successively.

Second Embodiment

FIGS. 14 to 17 are diagrams relating to a method for manufacturing the two-side adherable high-frequency induction heating container sealing member product of the present disclosure, and are drawings of a second embodiment showing a method for manufacturing the upper layer and the lower layer.

Referring to FIGS. 14 and 15, shown are a method for forming the two-side adherable high-frequency induction heating container sealing member by another method for forming the two-side adherable high-frequency induction heating container sealing member 100 integrated by thermally adhering the upper layer 10 and the lower layer 20 and it is largely divided into the upper layer 10 and the lower layer 20 when viewing each layer in cross section and each layer in the upper layer 10 is again the first thermal-adhesion sealing layer 10-*a*, the print film layer 10-*b* (the print film layer has been described in FIG. 8 with respect to option), the first aluminum foil layer 10-*c*, the intermediate base layer 10-*d*, and the synthetic resin layer from the top and is selected as one having hardness and tensile strength. In the present disclosure, it is preferable to form the Polyester layer 10-*e*.

Next, the first thermal-adhesion resin layer 10-*g* is successively laminated to be integrated and at this time, the first thermal-adhesion resin layer 10-*g* forms the first thermal-adhesion resin layer made of Polyethylene or Polypropylene.

There is a method for thermally adhering with the lower layer 20, and since polyethylene or Polypropylene is not thermally adhered with the aluminum foil layer, this method is a method for forming the second thermal-adhesion resin layer 20-*c* of Polyethylene or Polypropylene, etc. of the same material as that of the lower surface of the upper layer even on the upper surface of the second aluminum foil layer 20-*a* of the lower layer 20, such that the upper layer and the lower layer thus formed are thermally adhered to be integrated to form the two-side adherable high-frequency induction heating container sealing member.

Since Polyolefin-based resin of Polyethylene or Polypropylene is not thermally adhered to a metal material such as aluminum, it is laminated with the second aluminum foil layer 20-*a* by using a general adhesive agent (urethane-based adhesive agent is much used) or even when coating, the adhesive agent is first applied to the second aluminum foil layer 20-*a* with primer and then the resin is coated.

In general, as in the second embodiment, the Polyethylene resin is much used as a material of the first thermal-adhesion resin layer and the second thermal-adhesion resin layer but in the case of a product that should withstand a temperature of 120° C. or more like a retort product, Polypropylene resin whose melting point is 160° C. is used. It is preferable that the first thermal-adhesion sealing layer 10-*a* and the second thermal-adhesion sealing layer 20-*b* are made of the thermoplastic adhesion resin of the same material as those of the cover ring 300 and the container 200 attached by applying the two-side adherable high-frequency induction heating container sealing member.

Herein, it is preferable that the material of the thermoplastic adhesion resin is made of Polyethylene, Polypropylene, Polyethylene Terephthalate, Ethylene Vinyl Acetate, etc.

Herein, it is preferable that in the case where the materials of the cover ring and the container or the cover ring and the mesh fixing ring including the mesh are a glass or metal material, the first thermal-adhesion sealing layer 10-*a* and the second thermal-adhesion sealing layer 20-*b* are made of Ionomer or Ethylene Acrylic Acid.

It is preferable that in the case that only the material of the container is a glass or metal material, the second thermal-adhesion sealing layer 20-*b* is made of Ionomer or Ethylene Acrylic Acid.

This method has an advantage in that the second aluminum foil layer 20-*a* of the lower layer 20 cannot be directly exposed to the air, thereby preventing oxidation.

Then, in a structure of the lower layer, the second aluminum foil layer 20-*a* is a layer for the high-frequency induction heating and melts the second thermal-adhesion sealing layer 20-*b*, which is the lowermost portion of the lower layer thereof, downwards by the heat thus generated by the induction heating to be thermally adhered with the container, and on the other hand, is a layer of sealing the container substantially together with the second thermal-adhesion sealing layer and blocks moisture or oxygen, etc. from the outside due to the characteristics of the metal material from being transmitted, thereby preventing the contents from being changed and conversely, preventing the contents of the container from being leaked or evaporated. Then, when being opened, the second aluminum foil layer 20-*a* serves as the seal that is opened while being subject to shear failure together with the second thermal-adhesion sealing layer 20-*b* of the lower layer 20 thereof.

It is preferable that the first aluminum foil layer 10-*c* and the second aluminum foil layer 20-*a* have a thickness of 0.009 to 0.1 mm.

FIG. 15 is a diagram showing that the second thermal-adhesion resin layer 20-*c* is formed on the upper portion of the lower layer of FIG. 9.

FIG. 16 is a cross-sectional diagram showing that the upper layer and the lower layer of FIG. 15 has been attached.

FIG. 17 is a diagram of a second embodiment showing the two-side adherable high-frequency induction heating container sealing member of the present disclosure.

The second embodiment is manufactured through the step of FIG. 13.

The second embodiment further forms the second thermal-adhesion resin layer 20-*c* on the upper portion of the lower layer in addition to the first embodiment.

The pre-formation of the opening tab 101, the opening guide cut strip 102, the thermal-adhesion sealing strip 103, and the opening guide cut line 104 in the configuration is the same as the case of FIGS. 11 to 13.

Application Embodiment 1

FIGS. 18 to 26 relate to an Application embodiment 1 of applying the above-described two-side adherable high-frequency induction heating container sealing member to the container.

FIG. 18 is a diagram for explaining an Application embodiment 1 applying the two-side adherable high-frequency induction heating container sealing member of the present disclosure to the container, and is a diagram showing that the two-side adherable high-frequency induction heating container sealing member 100 of the present disclosure has been applied between the cover ring 300 and the container 200.

In a compact cosmetic container composed of the container 200; and the cover ring 300 on the upper portion of the container 200, formed is the compact cosmetic container applying the two-side adherable high-frequency induction heating container sealing member 100 that forms the two-side adherable high-frequency induction heating container sealing member 100 of the present disclosure between the container 200 and the cover ring 300 so as to be integrally sealed when passing through the induction heating device.

Shown is a state where the inlet surface of the container 200 and the lower inner surface of the cover ring 300 have been sealed on both side surfaces of the uppermost surface and the lowermost surface of the two-side adherable high-frequency induction heating container sealing member 100 of the present disclosure.

The present disclosure plays a role such as tamper evident and provides the function for protecting the consumer.

Since the product of the present disclosure seals the container, it can be recognized when someone releases the sealing, thereby confirming whether the product is defective.

FIG. 19 is a cross-sectional diagram of the line A-A' of FIG. 8.

It can be seen that the two-side adherable high-frequency induction heating container sealing member 100 of the present disclosure is disposed between the container 200 and the cover ring 300.

FIG. 20 is an exploded diagram of FIG. 18.

FIG. 20 is a diagram showing a structure disposed from the bottom to the top and is composed of the container 200, the two-side adherable high-frequency induction heating container sealing member 100 of the present disclosure, and the covering ring 300.

FIG. 21 is a cross-sectional diagram for each part of FIG. 20.

FIG. 22 is a diagram showing a state where the two-side adherable high-frequency induction heating container sealing member starts to be torn from the compact cosmetic container applying the product of the present disclosure.

FIG. 22 is a diagram that the opening tab 101 and the opening guide cut strip 102, which are the central inner surface, starts to be separated together with the second aluminum foil layer adhered to the lower portion thereof along the opening guide cut line 104 of the two-side adherable high-frequency induction heating container sealing member on the same positional line as the inner circumferential surface on the lower portion of the cover ring 300 when the opening tab 101 on the upper central portion of the two-side adherable high-frequency induction heating container sealing member 100 is pulled upwards.

FIG. 23 is a diagram showing a state where the opening tab is further separated with the second aluminum foil layer in FIG. 22 to be detached from the container.

FIG. 24 is a cross-sectional diagram of FIG. 22.

FIG. 25 is an enlarged diagram of a cross-sectional diagram in which the opening guide cut line 104 is formed on the two-side adherable high-frequency induction heating container sealing member applied to FIG. 22.

FIG. 25 is a diagram showing that the two-side adherable high-frequency induction heating container sealing member, which is the product of the present disclosure, is applied for sealing the cover ring 300 and the container 200 and shows a state where the first thermal-adhesion sealing layer 10-*a*, which is the uppermost surface of the upper layer of the two-side adherable high-frequency induction heating container sealing member, is thermally adhered to the upper inner circumferential surface of the cover ring to be sealed and the second thermal-adhesion sealing layer 20-*b*, which is the lowermost surface of the lower layer that is the opposite surface thereto, is thermally adhered to the inlet surface of the container 200 to be sealed.

FIG. 23 is a diagram showing a state where the two-side adherable high-frequency induction heating container sealing member has been torn from the container.

As shown in FIGS. 24 to 26, the opening guide cut line 104 is formed to coincide with the inner circumferential surface of the cover ring 300 or at the outside of the inner circumferential surface of the cover ring 300 so that the cut surface of the two-side adherable high-frequency induction heating container sealing member is not viewed well when viewing the cover ring and the inlet of the container from the top in a state where the two-side adherable high-frequency induction heating container sealing member has been opened, and is formed so that the opened boundary surface portion is not viewed well from the outside when the two-side adherable high-frequency induction heating container sealing member 100 has been detached from the container, thereby neatly clearing the appearance even after the container has been opened.

Application Embodiment 2

FIGS. 27 to 34 are used as the application different from FIGS. 18 to 21 in applying the two-side adherable high-frequency induction heating container sealing member 100 according to an Application embodiment 2 applying the two-side adherable high-frequency induction heating container sealing member of the present disclosure to the container to the compact cosmetic container and are a perspective diagram (FIG. 27) and a cross-sectional diagram (FIG. 28) in which the upper portion of the two-side adherable high-frequency induction heating container sealing member 100 seals the upper inner circumferential surface of the cover ring 300 and the lower portion of the two-side adherable high-frequency induction heating container sealing member 100 seals the upper end surface of the mesh fixing ring 400 including the mesh.

FIGS. 27 to 34 are different from FIGS. 18 to 21 in that the compact cosmetic container having the tamper function applying the two-side adherable high-frequency induction heating container sealing member 100 further forming the mesh fixing ring 400 including the mesh between the container 200 and the two-side adherable high-frequency induction heating container sealing member 100 is shown.

FIG. 28 is a cross-sectional diagram of the line A-A' of FIG. 27.

FIG. 29 is an exploded diagram for each part of FIG. 27.

FIG. 29 is a diagram showing that the container 200, the mesh fixing ring 400 including the mesh, the two-side adherable high-frequency induction heating container sealing member 100, and the cover ring 300 are coupled to each other in this order from the bottom to the top.

Herein, the mesh fixing ring 400 including the mesh can be selected and added when the user uses it by coating an appropriate amount of powder.

FIG. 30 is a cross-sectional diagram for each part of FIG. 29.

FIG. 33 corresponds to FIGS. 27 to 30 and is applied to the container to which the two-side adherable high-frequency induction heating container sealing member has been applied.

FIG. 33 is a diagram of applying for sealing the two-side adherable cover ring 300 and the mesh fixing ring 400 including the mesh when the tab is held and lifted by a hand and the first thermal-adhesion sealing layer 10-*a*, which is the uppermost surface of the upper layer 10 of the two-side adherable high-frequency induction heating container sealing member, is thermally adhered to the upper inner circumferential surface of the cover ring 300 to be sealed and the second thermal-adhesion sealing layer 20-*b*, which is the lowermost surface of the lower layer that is the opposite surface thereto, is thermally adhered to the upper surface of the mesh fixing ring 400 including the mesh to be sealed.

FIG. 33 is a diagram showing that the two-side adherable high-frequency induction heating container sealing member is torn from the container.

FIG. 34 is a diagram showing a state where the two-side adherable high-frequency induction heating container sealing member is torn from the container.

Related Art of Application Embodiment 3

FIGS. 35 to 39 are diagrams showing a conventional flip-cap container.

As shown in FIGS. 35 to 39, even in the case of the flip-cap having a structure that is generally fastened to a container by a conventional screw or a one-touch method, there has been cumbersome and inconvenience in that the container 70 is sealed but the entire cap 80 is opened and completely separated from the container and then the seal 60 is removed on the container and then the cap is closed again in order to remove the seal 60 by the consumer, and thereafter, it is opened and closed only by the auxiliary cap 81 on the upper portion thereof.

Conventionally, when the flip-cap is detached from the container, the sealing member is attached to the inlet of the container but the present disclosure has more perfect tamper evident function due to the two-side adherable high-frequency induction heating container sealing member adhered to both surfaces of the main body of the flip-cap and the inlet of the container.

The present disclosure has the function capable of removing the two-side adherable high-frequency induction heating container sealing member of the inlet even if the auxiliary cap can be opened but the main body of the flip-cap is not detached from the container.

Application Embodiment 3

However, there is the following advantage by applying the two-side adherable high-frequency induction heating container sealing member of the present disclosure.

FIGS. 40 to 47 are diagrams showing a state where the two-side adherable high-frequency induction heating container sealing member starts to be torn from the flip-cap container corresponding to an Application third embodiment of the present disclosure applying the two-side adherable high-frequency induction heating container sealing member, which is the product of the present disclosure.

FIGS. 40 to 47 are diagrams showing that the opening tab 101 and the opening guide cut strip 102, which are the central inner surface, start to be separated together with the second aluminum foil layer adhered to the lower portion thereof along the opening guide cut line 104 of the two-side adherable high-frequency induction heating container sealing member on the same positional line as the inner circumferential surface on an upper inner circumferential surface 521 of the flip-cap main body when the opening tab 101 on the upper central portion of the two-side adherable high-frequency induction heating container sealing member 100 is pulled upwards.

FIG. 41 is a cross-sectional diagram of FIG. 40.

A flip-cap 500 is formed of a structure having an auxiliary cap 510 while having a hinge.

FIG. 42 is an exploded diagram of FIG. 40.

FIG. 42 is a perspective diagram showing that the two-side adherable high-frequency induction heating container sealing member 100 is interposed between the flip-cap 500 and the container 200. The first thermal sealing layer on the upper portion of the two-side adherable high-frequency induction heating container sealing member 100 is attached to the upper inner circumferential surface 521 of a main body 520 of the flip-cap.

The flip-cap 500 is composed of the main body 520 and the auxiliary cap 510 and the auxiliary cap 510 has the form of the hinge and is connected to the main body 520.

FIG. 43 is a diagram showing a state where the auxiliary cap 510 has been opened after applying the two-side adherable high-frequency induction heating container sealing member 100 to the container 200.

FIG. 43 is a perspective diagram showing that the two-side adherable high-frequency induction heating container sealing member 100 has been interposed between the flip-cap 500 and the container 200.

Firstly, the first thermal sealing layer 10-*a* of the two-side adherable high-frequency induction heating container sealing member 100 is disposed on the upper inner circumferential surface 521 of the main body 520 of the flip-cap 500, and in addition, the second thermal sealing layer 20-*b* is disposed at the inlet of the container 200 to be sealed in the inlet of the container 200 and the upper inner circumferential surface 521 of the main body 520 of the flip-cap 500 through the induction heating device.

The sealing of the first thermal sealing layer and the second thermal sealing layer can also be performed simultaneously and can also be performed successively.

Since it has the two-side adhesion, there are the following advantageous effects.

According to the above configuration, the container having the flip-cap 500 with the tamper evident function is formed.

FIG. 44 is a cross-sectional diagram of FIG. 43.

It can be seen that the two-side adherable high-frequency induction heating container sealing member has been attached to the upper inner circumferential surface 521 of the main body 520 of the flip-cap 500.

FIG. 45 is a diagram showing a first stage of tearing the two-side adherable high-frequency induction heating container sealing member 100 sealed in the container from the container and is a diagram showing a state where the opening tab is lifted.

FIG. 46 is a diagram showing a state where the two-side adherable high-frequency induction heating container sealing member 100 has been separated from the inlet of the container.

FIG. 47 is a cross-sectional diagram of FIG. 46.

As shown in FIGS. 46 and 47, the opening guide cut line 104 is formed to coincide with the upper inner circumferential surface 521 of the main body 520 of the flip-cap 500 or further outwards than the upper inner circumferential surface 521 of the main body 520 of the flip-cap 500, that is, toward the container side so that the cut surface of the two-side adherable high-frequency induction heating container sealing member 100 is not viewed well when viewing the main body 520 of the flip-cap 500 and the inlet of the container in a state where the two-side adherable high-frequency induction heating container sealing member 100 has been opened, and is formed to have an aesthetic effect when viewing the container from the top even after use and forms the container having the flip-cap with the tamper evident function.

Firstly, there is the convenience capable of using by opening only the auxiliary cap 510 formed of a flip structure on the upper portion thereof without opening the entire flip cap 500 to remove the seal and taking out the contents in the container by a method of FIGS. 43, 44, 45, and 46.

Secondly, since the consumer can never open arbitrarily or disassemble the cap and the container and open and close only by the auxiliary cap on the upper portion thereof by the two-side adherable high-frequency induction heating container sealing member weld-sealing both sides between the cap and the container, the container, the cap, and the two-side adherable high-frequency induction heating container sealing member can be integrated not to be disassembled, thereby having the perfect tamper evident function.

The terms and words used in the specification and the claims should not be construed as limiting in an ordinary or dictionary sense, and should be only construed in the meaning and the concept consistent with the technical spirit of the present disclosure in light of the principle in which the inventor can define the concept of the term appropriately in order to describe its own disclosure in a sincere manner.

INDUSTRIAL APPLICABILITY

The present disclosure has the tamper evident function by exerting the effect of integrating and fixing so that the cover ring and the container cannot be separated by sealing both the upper and lower surfaces with the two-side adherable high-frequency induction heating container sealing member interposed between the container cover and the container of a ring shape, such that it is applicable industrially.

The invention claimed is:

1. A two-side adherable high-frequency induction heating container sealing member, comprising:

an upper layer, the upper layer forming a first thermal-adhesion sealing layer;

a first aluminum foil layer; an intermediate base layer;

a synthetic resin layer; and a first thermal-adhesion resin layer from the top to the bottom successively, and the upper layer having a preformed opening guide cut line-provided opening tab, a preformed opening guide cut strip, and a preformed thermal-adhesion sealing strip; and a lower layer, the lower layer forming a second aluminum foil layer and a second thermal-adhesion sealing layer from the top to the bottom successively, wherein the first thermal-adhesion resin layer formed on the lower portion of the upper layer and the second aluminum foil layer formed on the upper portion of the lower layer are integrated by the thermal adhesion.

2. The two-side adherable high-frequency induction heating container sealing member of claim 1, wherein a second thermal-adhesion resin layer is further formed on the upper portion of the second aluminum foil layer.

3. The two-side adherable high-frequency induction heating container sealing member of claim 1, wherein the first thermal-adhesion resin layer formed on the lower end portion of the upper layer is Polymer made of Copolymer of Ethylene Vinyl Acetate or Ethylene Acrylic Acid having a strong thermal-adhesion against metal so as to have the thermal adhesion with the second aluminum foil layer formed on the lower layer.

4. The two-side adherable high-frequency induction heating container sealing member of claim 1, wherein the synthetic resin layer is formed of a film made of Polyester, Polypropylene or Polycarbonate bi-axially stretched.

5. The two-side adherable high-frequency induction heating container sealing member of claim 1, wherein the first thermal-adhesion resin layer forms a layer by using an extrusion device or laminating a film for coupling with the synthetic resin layer.

6. The two-side adherable high-frequency induction heating container sealing member of claim 1, wherein the first thermal-adhesion resin layer is formed by coating a hot-melt adhesive agent made of the main material of Nylon, Ethylene Vinyl Acetate, Polyester, etc. or laminating a film.

7. The two-side adherable high-frequency induction heating container sealing member of claim 2, wherein the second thermal-adhesion resin layer is laminated on the upper portion of the second aluminum foil layer so that the upper layer and the lower layer are integrated by applying heat and pressure thereto, and the first thermal-adhesion resin layer and the second thermal-adhesion resin layer are made of Heat Seal Polymer of the same material made of Polyethylene, Polypropylene, or Ethylene Vinyl Acetate so that the second aluminum foil layer is not directly exposed to the air, thereby preventing oxidation and having high heat resistance.

8. The two-side adherable high-frequency induction heating container sealing member of claim 2, wherein the first thermal-adhesion sealing layer and the second thermal-adhesion sealing layer are made of thermoplastic adhesion resin of the same material as that of the container attached by applying the two-side adherable high-frequency induction heating container sealing member.

9. The two-side adherable high-frequency induction heating container sealing member of claim 8, wherein the material of the thermoplastic adhesion resin is made of one or more kinds selected from Polyethylene, Polypropylene, Polyethylene Terephthalate, and Ethylene Vinyl Acetate.

10. The two-side adherable high-frequency induction heating container sealing member of claim 8, wherein the second thermal-adhesion sealing layer is made of Ionomer or Ethylene Acrylic Acid when the material of the container is a glass or metal material.

11. The two-side adherable high-frequency induction heating container sealing member of claim 1, wherein a print film layer for printing a design and a trademark or a business name for promoting a product is further formed between the first thermal-adhesion sealing layer and the first aluminum foil layer.

12. The two-side adherable high-frequency induction heating container sealing member of claim 11, wherein the material of the print film layer is made of a Polyester film or a Polypropylene film.

13. A compact cosmetic container having a tamper function applying a two-side adherable high-frequency induction heating container sealing member of claim 1, wherein the two-side adherable high-frequency induction heating container sealing is formed between the upper portion of a container and a cover ring so as to be integrally sealed when passing through an induction heating device.

14. The compact cosmetic container having the tamper function applying the two-side adherable high-frequency induction heating container sealing member of claim 13, wherein a mesh fixing ring comprising a mesh is further formed between the container and the two-side adherable high-frequency induction heating container sealing member.

15. The compact cosmetic container having the tamper function applying the two-side adherable high-frequency induction heating container sealing member of claim 13, wherein an opening guide cut line of the two-side adherable high-frequency induction heating container sealing member is formed to coincide with the inner circumferential surface of the cover ring or at the outside of the inner circumferential surface of the cover ring so that the cut surface of the two-side adherable high-frequency induction heating container sealing member is not viewed well when viewing the cover ring and the inlet of the container from the top in a state where the two-side adherable high-frequency induction heating container sealing member has been opened.

16. The compact cosmetic container having the tamper function applying the two-side adherable high-frequency induction heating container sealing member of claim 13, wherein the first thermal-adhesion sealing layer and the second thermal-adhesion sealing layer are made of a thermoplastic adhesion resin of the same material as those of the cover ring and the inlet of the container or the cover ring and a mesh fixing ring comprising a mesh attached by applying the two-side adherable high-frequency induction heating container sealing member.

17. The compact cosmetic container having the tamper function applying a two-side adherable high-frequency induction heating container sealing member of claim 1, wherein when the materials of the cover ring and the inlet of the container or the cover ring and the mesh fixing ring comprising the mesh are a glass or metal material, the first thermal-adhesion sealing layer and the second thermal-adhesion sealing layer are made of Ionomer or Ethylene Acrylic Acid.

18. The compact cosmetic container having the tamper function applying the two-side adherable high-frequency induction heating container sealing member of claim 1, wherein the two-side adherable high-frequency induction heating container sealing member is disposed and formed between the container and the upper inner portion of a main body of a flip-cap so as to be integrally sealed while passing through the induction heating device after the flip-cap has been coupled to the container.

19. The compact cosmetic container having the tamper function applying the two-side adherable high-frequency induction heating container sealing member of claim 1, wherein the opening guide cut line of the two-side adherable high-frequency induction heating container sealing member is formed to coincide with the upper inner circumferential surface of the main body of a flip-cap or further outwards than the inner circumferential surface of the main body of the flip-cap so that the cut surface of the two-side adherable high-frequency induction heating container sealing member is not viewed well when viewing the main body of the flip-cap and the inlet of the container from the top in a state where the two-side adherable high-frequency induction heating container sealing member has been opened.

20. The compact cosmetic container having the tamper function applying the two-side adherable high-frequency induction heating container sealing member of claim 1, wherein the first thermal-adhesion sealing layer and the second thermal-adhesion sealing layer are made of a thermoplastic adhesion resin of the same material as those of a flip-cap and the inlet of the container attached by applying the two-side adherable high-frequency induction heating container sealing member.

* * * * *